US008811877B2

(12) United States Patent
Ko et al.

(10) Patent No.: US 8,811,877 B2
(45) **Date of Patent: *Aug. 19, 2014**

(54) INDUCTION HEATING TYPE FUSING DEVICE AND IMAGE FORMING APPARATUS EMPLOYING THE SAME

(71) Applicant: Samsung Electronics Co., Ltd., Suwon-si (KR)

(72) Inventors: Young-dae Ko, Suwon-si (KR); Keon Kuk, Yongin-si (KR); Jun-o Kim, Yongin-si (KR); Dae-hwan Kim, Seoul (KR); Tatsuhiro Otsuka, Suwon-si (KR); Jin-han Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/079,557

(22) Filed: Nov. 13, 2013

(65) Prior Publication Data

US 2014/0064807 A1 Mar. 6, 2014

Related U.S. Application Data

(63) Continuation of application No. 13/067,391, filed on May 27, 2011, now Pat. No. 8,611,803.

(30) Foreign Application Priority Data

May 31, 2010 (KR) ..... 10-2010-0051436

(51) Int. Cl.
*G03G 15/20* (2006.01)

(52) U.S. Cl.
USPC ..... 399/329; 219/619

(58) Field of Classification Search
USPC ..... 399/329; 219/216, 619
See application file for complete search history.

(56) References Cited

U.S. PATENT DOCUMENTS

| | | | | |
|---|---|---|---|---|
| 5,778,294 | A | 7/1998 | Hiraoka et al. | 399/329 |
| 7,079,802 | B2 | 7/2006 | Katayanagi et al. | 399/331 |
| 8,611,803 | B2 * | 12/2013 | Ko et al. | 399/329 |
| 2005/0271433 | A1 | 12/2005 | Ono et al. | 399/329 |

(Continued)

FOREIGN PATENT DOCUMENTS

JP 2007-3968 1/2007

OTHER PUBLICATIONS

Patent Abstracts of Japan, Publication No. 2007-003968, Published Jan. 11, 2007.

(Continued)

*Primary Examiner* — Sophia S Chen
(74) *Attorney, Agent, or Firm* — Staas & Halsey LLP

(57) ABSTRACT

An induction heating type fusing device and an image forming apparatus including the fusing device. The fusing device includes a magnetic flux generator and a compressing roller outside a fusing belt, first and second fusing rollers and a nip guide inside the fusing belt. The compressing roller compresses against the first and second fusing rollers and the nip guide to form nips, while the fusing belt is disposed between the compressing roller and the first and second fusing rollers and the nip guide.

30 Claims, 6 Drawing Sheets

(56) References Cited

U.S. PATENT DOCUMENTS

| | | | | |
|---|---|---|---|---|
| 2007/0071523 | A1 | 3/2007 | Suzuki | 399/329 |
| 2007/0212091 | A1 | 9/2007 | Kinouchi et al. | 399/69 |
| 2007/0230984 | A1 | 10/2007 | Noguchi | 399/69 |
| 2008/0019742 | A1 | 1/2008 | Ohno | 399/333 |
| 2008/0149621 | A1 | 6/2008 | Kanou et al. | 219/619 |
| 2009/0208265 | A1 | 8/2009 | Nakamoto et al. | 399/329 |
| 2009/0245902 | A1 | 10/2009 | Gon et al. | 399/331 |

OTHER PUBLICATIONS

Non-final Office Action issued Apr. 19, 2013 in co-pending U.S. Appl. No. 13/067,391.

Notice of Allowance issued Aug. 12, 2013 in co-pending U.S. Appl. No. 13/067,391.

U.S. Appl. No. 13/067,391, filed May 27, 2011, Young-dae Ko et al., Samsung Electronics Co., Ltd.

* cited by examiner

INDUCTION HEATING TYPE FUSING DEVICE AND IMAGE FORMING APPARATUS EMPLOYING THE SAME

CROSS-REFERENCE TO RELATED APPLICATIONS

This application is a Continuation application filed under 35 U.S.C. §120 of application Ser. No. 13/067,391 filed May 27, 2011, and claims the benefit of priority from the prior Korean Patent Application No. 10-2010-0051436, filed on May 31, 2010, in the Korean Intellectual Property Office, the disclosure of which is incorporated herein in its entirety by reference.

BACKGROUND

1. Field

The present general inventive concept relates to an induction heating type fusing device and an image forming apparatus including the fusing device.

2. Description of the Related Art

In an electrophotographic type image forming apparatus, a toner is supplied to an electrostatic latent image formed on an image receiving body to form a visible toner image on the image receiving body, the toner image is transferred onto a printing medium such as paper, and the transferred toner image is fused on the printing medium. The fusing process is mainly performed by using heat and pressure to permanently fix the toner onto the printing medium. A fusing device for performing the fusing operation generally includes a heating unit for heating the printing medium, and a pressing unit that presses against the heating unit, by which the printing medium is compressed when the printing medium passes between the pressing unit and the heating unit. Therefore, when the printing medium, on which the toner image is transferred, is conveyed to the fusing device, the printing medium passes between the heating unit and the pressing unit of the fusing device so that the toner image may be fused on the printing medium.

A conventional fusing device includes a fusing roller for generating heat by using a halogen lamp in order to heat the printing medium, and a compressing roller that is elastically adhered to the fusing roller to form a fusing nip. The fusing roller includes the halogen lamp, and a metal supporting pipe, an elastic layer, and a release layer disposed sequentially on the halogen lamp. Heat generated by the halogen lamp is radiated to the supporting pipe, and thus, a temperature of a surface of the fusing roller may be increased.

Another kind of conventional fusing device includes an induction heating type fusing roller for heating the printing medium, and a compressing roller that is elastically adhered to the fusing roller to form the fusing nip. The fusing roller includes a metal supporting pipe, and a heat insulating layer, a metal heating layer, an elastic layer, and a release layer disposed sequentially on the metal supporting pipe. In addition, a magnetic flux generating device is formed on the fusing roller. Thus, heat may be generated by the heating layer by induction heating, and the temperature of the surface of the fusing roller may be increased.

SUMMARY

The present general inventive concept provides an induction heating type fusing device to provide a large amount of nip and improved durability, while having a compact size, and an image forming apparatus including the fusing device.

According to an aspect of the present general inventive concept, there is provided a fusing device including: a fusing belt formed as a closed loop; a magnetic flux generator disposed outside the fusing belt to emit magnetic flux for induction heating of the fusing belt; a first fusing roller and a second fusing roller that are disposed inside to be parallel with each other in the fusing belt and that suspend the fusing belt; a nip guide located between the first fusing roller and the second fusing roller; and a compressing roller disposed on the outer portion of the fusing belt, and for compressing the first and second fusing rollers and the nip guide to form nips on portions of the fusing belt where the compressing roller contacts the first and second fusing rollers and the nip guide.

The magnetic flux generator may include: a coil wound along a length direction of the first and second fusing rollers; a magnetic core disposed to face the fusing belt while the coil is disposed between the magnetic core and the fusing belt to guide magnetic flux generated by the coil; and a bobbin on which the coil and the magnetic core are formed.

A cross-section of the coil may be curved along an outer circumference of the fusing belt with respect to the first fusing roller and with respect to the second fusing roller.

The magnetic core may include: a main core including a plurality of core pieces that are arranged in the length direction of the first and second fusing rollers; and two end cores extending in the length direction of the first and second fusing rollers and contacting ends of the plurality of core pieces.

Each of the plurality of core pieces may have an arch-shaped cross-section.

The core pieces located at ends among the plurality of core pieces may have an E-shaped cross-section having a protruding center portion.

The core pieces located at both ends among the plurality of core pieces may have a core body having an arch-shaped cross-section and a center core having a first side contacting a center portion of the core body and a second side located inside the coil.

The fusing belt may include a release layer and a heating layer. The fusing belt may further include an elastic layer. The release layer may be an outer layer of the fusing belt, the heating layer is an inner layer of the fusing belt, and the elastic layer is disposed therebetween. The heating layer may include a conductive layer formed of a conductive magnetic material.

Each of the first and second fusing rollers may include a supporting layer and a heat insulating layer surrounding the supporting layer.

The nip guide may include an elastic layer contacting an inner surface of the fusing belt, and a supporting layer supporting the elastic layer.

The compressing roller may include a release layer, an elastic layer, and a supporting layer. The supporting layer of the compressing roller may be a hollow shaft or a rod.

The fusing device may further include a second heat source for heating the compressing roller, the second heat source disposed inside the compressing roller. The second heat source may be a halogen lamp.

The fusing device may further include a second heat source for heating the compressing roller, the second heat source disposed outside of the compressing roller. The second heat source may be formed of a halogen lamp and a thin pipe surrounding the halogen lamp.

According to another aspect of the present invention, there is provided an image forming apparatus including: electrophotographic type printing units for transferring toner images onto a printing medium; and a fusing device for fusing the transferred toner images on the printing medium, wherein the fusing device may include: a fusing belt formed as a closed loop; a magnetic flux generator disposed outside the fusing belt to emit magnetic flux for induction heating of the fusing belt; a first fusing roller and a second fusing roller that are disposed in parallel with each other inside the fusing belt and suspend the fusing belt; a nip guide located between the first fusing roller and the second fusing roller; and a compressing roller disposed on the outer portion of the fusing belt, and for compressing the first and second fusing rollers and the nip guide to form nips on portions of the fusing belt, where the compressing roller contacts the first and second fusing rollers and the nip guide.

The magnetic flux generator may include: a coil wound along a length direction of the first and second fusing rollers; a magnetic core disposed to face the fusing belt while the coil is disposed between the magnetic core and the fusing belt to guide magnetic flux generated by the coil; and a bobbin on which the coil and the magnetic core are formed.

BRIEF DESCRIPTION OF THE DRAWINGS

The above and other features and advantages of the present general inventive concept will become more apparent by describing in detail exemplary embodiments thereof with reference to the attached drawings in which.

Other features and advantages of the present invention will be apparent from the following description taken in conjunction with the accompanying drawings, in which like reference characters designate the same or similar parts throughout the figures thereof.

DETAILED DESCRIPTION

The present general inventive concept will now be described more fully with reference to the accompanying drawings, in which exemplary embodiments of the present general inventive concept are shown.

Figure 1:
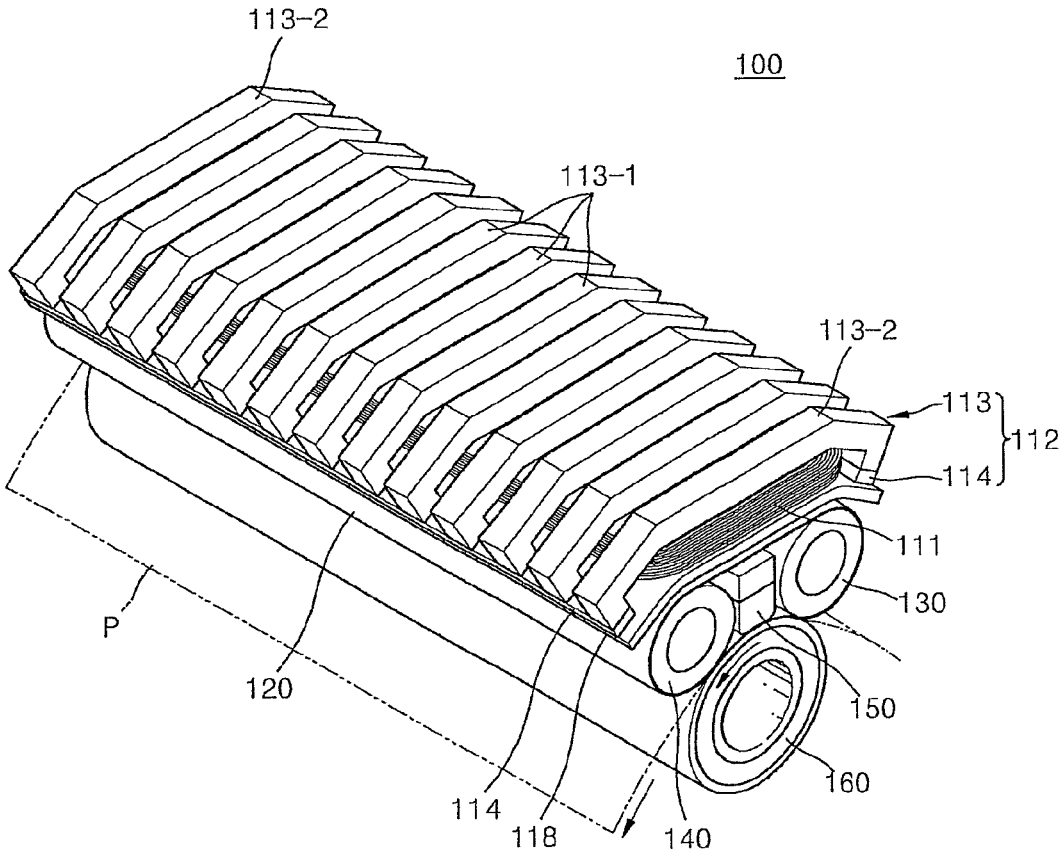
FIG. 1 is a schematic perspective view of a fusing device according to an embodiment of the present general inventive concept.
Figure 2:
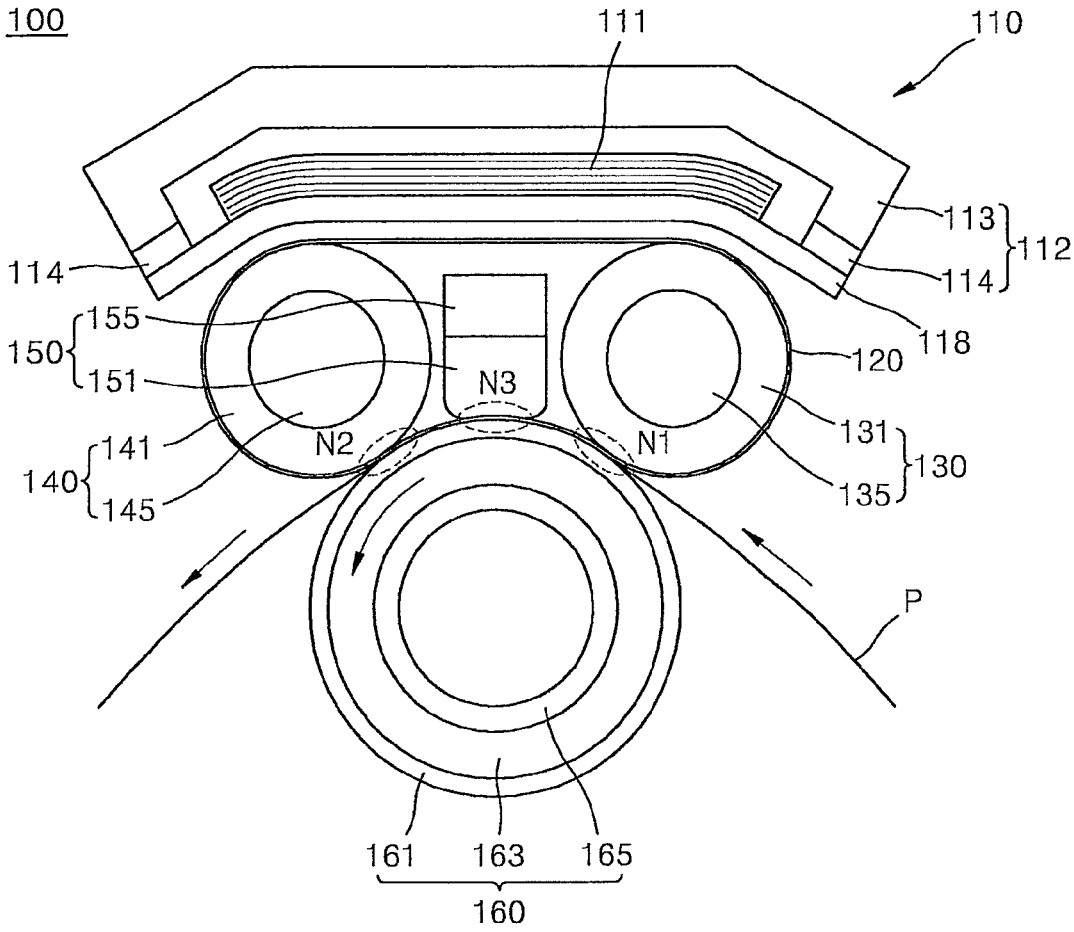
FIG. 2 is a cross-sectional view of the fusing device of FIG. 1.
Figure 3:
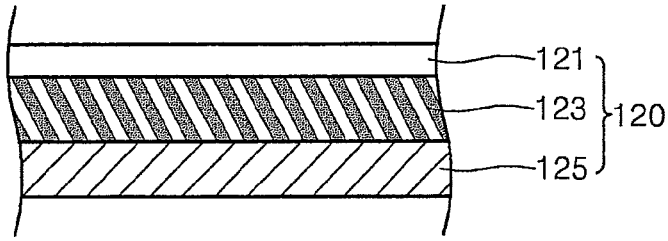
FIG. 3 is a schematic cross-sectional view of a fusing belt in the fusing device of FIG. 1.

FIG. 1 is a schematic perspective view of a fusing device 100 according to an embodiment of the present general inventive concept, FIG. 2 is a cross-sectional view of the fusing device 100 of FIG. 1, and FIG. 3 is a schematic cross-sectional view of a fusing belt 120 in the fusing device 100 of FIG. 1.

Referring to FIGS. 1 through 3, the fusing device 100 according to the current embodiment includes a magnetic flux generating device 110, a fusing belt 120, a first and second fusing rollers 130 and 140, a nip guide 150, and a compressing roller 160.

The magnetic flux generating device 110 is disposed outside the fusing belt 120 to discharge magnetic flux through the fusing belt 120. The magnetic flux generating device 110 faces outer circumferences of the first and second fusing rollers 130 and 140 while the fusing belt 120 is disposed between the magnetic flux generating device 110 and the fusing rollers 130 and 140, and at the same time, is disposed in parallel with the first and second fusing rollers 130 and 140 along a length direction (that is, an axial direction) of the first and second fusing rollers 130 and 140.

The magnetic flux generating device 110 includes a coil 111, a magnetic core 112, and a bobbin 118.

The coil 111 is formed as a long track along the length direction of the first and second fusing rollers 130 and 140. For example, the coil 111 may be formed by winding a coil along the length direction of the first and second fusing rollers 130 and 140 in parallel with a surface facing the fusing belt 120. A cross-section of the coil 111 may be bent along an outer circumference of the fusing belt 120 with respect to the first fusing roller 130 and with respect to the second fusing roller 140 as shown in FIG. 2, so that magnetic flux generated by the coil 111 may pass through a wide area of the fusing belt 120. A radio frequency (RF) inverter (not shown) is connected to the coil 111 so as to supply RF electric power, for example, 100 to 2000 W at 10 to 100 kHz, to the coil 111. In order to prevent loss of RF electric power, a Litz wire may be used as the coil 111. A Litz wire is a copper wire formed by twisting tens to hundreds of fine wire strips that are coated with an insulating material at a constant pitch. The insulating material coated on the fine wires may have thermal-resistance against heat generated by the coil 111 when a current is applied to the coil 111.

The magnetic core 112 is disposed facing the fusing belt 120 with the coil 111 disposed therebetween. The magnetic core 112 may include a main core 113 and end cores 114.

The main core 113 may include a plurality of core pieces 113-1 and 113-2, each having an arch-shaped cross-section. The plurality of core pieces 113-1 and 113-2 are disposed at predetermined intervals in the length direction (that is, the axial direction) of the first and second fusing rollers 130 and 140. For example, each of the core pieces 113-1 and 113-2 may have a thickness of about 10 mm in the length direction of the first and second fusing rollers 130 and 140. The intervals between the plurality of core pieces 113-1 and 113-2 may vary depending on a magnetic field generated by the coil 111. For example, the plurality of core pieces 113-1 and 113-2 may be arranged at equal intervals. If necessary, the intervals between the core pieces 113-1 on a center portion of the main core 113 may be greater than the intervals corresponding to the core pieces 113-2, which may be end core pieces, so as to improve an induction heating property at opposite ends of the coil 111.

The end cores 114 may have a square-shaped cross-section, and may be extended in the length direction of the first and second fusing rollers 130 and 140. The end cores 114 are formed on opposite sides of the coil 111 and contact end portions of the plurality of core pieces 113-1 and 113-2.

Magnetic flux generated by the coil 111 forms a closed loop magnetic circuit, and the magnetic core 112 guides the magnetic flux formed around an upper portion of the coil 111 in FIG. 2 to improve an efficiency of the magnetic circuit. The magnetic core 112 may be formed of a ferrite material that has high permeability and lessens loss of energy due to eddy currents. A relative permeability of the magnetic core 112 may be about 1000 to about 5000, for example, about 2000 to about 4000.

Figure 4:
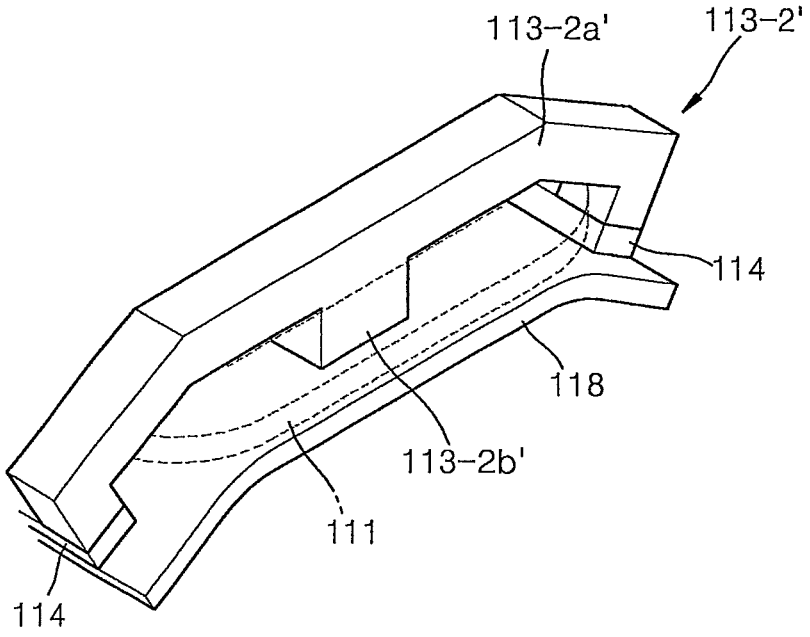
FIGS. 4 and 5 are perspective views showing modified examples of main cores disposed on end portions of the fusing device of FIG. 1.
Figure 5:
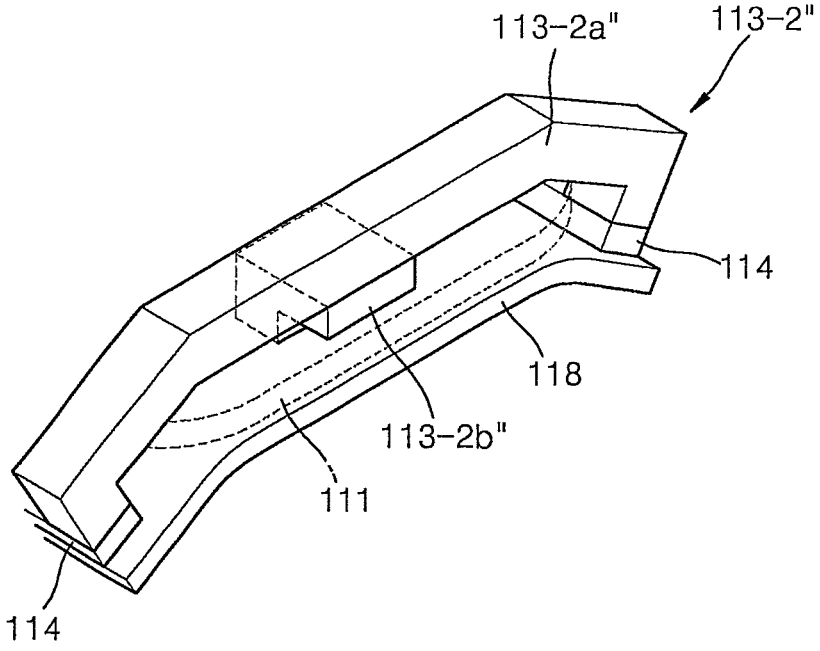

In the current embodiment, the plurality of core pieces 113-1 and 113-2 have arch-shaped cross-sections; however, the core pieces 113-1 and 113-2 may have variously modified cross-sections as shown in FIGS. 4 and 5. In addition, although the main core 113 consists of the plurality of core pieces 113-1 and 113-2 in the current embodiment, the main core 113 may be formed as one body, if necessary. Moreover, although the magnetic core 112 includes the main core 113 and the end cores 114 in the current embodiment, the main core 113 and the end cores 114 may be integrally formed with each other.

The bobbin 118 supports the coil 111 and the magnetic core 112, and maintains a constant distance between the coil 111 and the fusing belt 120. The distance between the coil 111 and the fusing belt 120 may be about 3 mm to about 6 mm. Since the coil 111 generates heat when an electric current flows in the coil 111, the bobbin 118 may be formed of a thermal-resistant resin such as a polyphenylene sulphide (PPS) or a polybutylene terephthalate (PBT).

The fusing belt 120 is a thin member formed as a closed loop. A width of the fusing belt 120 may be equal to or greater than a width of a printing medium P. The fusing belt 120 may be disposed around the first and second fusing rollers 130 and 140 and the nip guide 150. The fusing belt 120 is stretched over the first and second fusing rollers 130 and 140 and has a predetermined amount of tension.

The fusing belt 120 includes a release layer 121, an elastic layer 123, and a heating layer 125. The release layer 121 may be an outer layer of the fusing belt 120, the heating layer 125 may be an inner layer of the fusing belt 120, and the elastic layer 123 may be disposed therebetween.

The release layer 121 is a layer for improving a releasing property of the fusing belt 120 with respect to a toner transferred onto the printing medium P, and is located on an outer portion of the fusing belt 120, which is a portion that contacts the printing medium P. The release layer 121 may be formed of a silicon rubber, a fluoroelastomer, or a fluoropolymer such as perfluoroalkoxy (PFA) or polytetrafluoroethylene (PTFE). A thickness of the release layer 121 may be about 10 μm to about 50 μm, for example, 20 μm to about 40 μm.

The elastic layer 123 may be used to increase adhesion between the printing medium P and the first and second fusing rollers 130 and 140 and to improve the quality of fusing. Since thicknesses of color toners during full-color printing operation are thick, the elastic layer 123 may allow the color toners to be better fused. The elastic layer 123 may be formed of a silicon rubber or a fluoroelastomer having thermal resistance and elasticity. When the elastic layer 123 is too thin, the elasticity of the elastic layer 123 is insufficient, and when the elastic layer 123 is too thick, thermal efficiency thereof is low. Thus, a thickness of the elastic layer 123 may be appropriately selected according to design conditions. For example, the thickness of the elastic layer 123 may be about 50 μm to about 800 μm, for example, 100 μm to about 300 μm. If necessary, the elastic layer 123 may be omitted.

The heating layer 125 is a resistive heating layer for generating heat by an eddy current that is induced according to a change in a magnetic field generated by the magnetic flux generator 110. The heating layer 125 may include a conductive layer formed of a conductive magnetic material, for example, nickel, iron, or SUS430. The heating layer 125 may be formed to a thickness of about 10 μm to about 100 for example, 40 μm to about 70 μm. According to the fusing device 100 of the current embodiment, since the heating layer 125 generates heat by resistive heating, the temperature of the heating layer 125 rises quickly, and thus, a first page out time (FPOT) may be reduced, high speed fusing may be performed, and low power consumption may be achieved during standby mode of the fusing device 100.

The first and second fusing rollers 130 and 140 are disposed in parallel with each other and the fusing belt 120 is suspended thereon, Each of the first and second fusing rollers 130 and 140 may include a heat insulating layer 131 or 141 and a supporting layer 135 or 145.

The heat insulating layer 131 or 141 surrounds the supporting layer 135 or 145. The heat insulating layer 131 or 141 prevents heat generated by the fusing belt 120 from being transferred to the supporting layer 135, 145, and thus, reduces heat loss. The heat insulating layer 131 or 141 may be elastic in order to allow the fusing belt 120 to be curved and maintain a large nip width. For example, the heat insulating layer 131 or 141 may be formed of a rubber material or a resin-based silicon sponge having low thermal conductivity, heat-resistance, and elasticity. A thickness of the heat insulating layer 131 or 141 may be about 1 mm to about 10 mm, for example, about 3 mm to 7 mm. A degree of hardness of the heat insulating layer 131 or 141 may be about 20 to about 60 degrees on the Asker C hardness scale, for example, about 30 to about 50 degrees on the Asker C hardness scale.

The supporting layer 135 or 145 supports the first or second roller 130 or 140, and has thermal resistance and a predetermined degree of hardness. For example, the supporting layer 135 or 145 may be formed of a non-magnetic metal such as aluminium, or a magnetic metal such as steel use stainless (SUS). When the supporting layer 135 or 145 is formed of a non-magnetic metal, the supporting layer 135 or 145 is not affected by electromagnetic induction of the magnetic flux generator 110. The supporting layer 135 or 145 may be a steel hollow shaft having a thickness of 1.5 mm and an outer diameter of 15 to 25 mm. If the outer diameter of the supporting layer 135 or 145 is 20 mm or less, the supporting layer 135 or 145 may be a rod.

The nip guide 150 is disposed between the first and second fusing rollers 130 and 140. The nip guide 150 may include an elastic layer 151 and a supporting layer 155.

The elastic layer 151 is extended in the length direction of the first and second fusing rollers 130 and 140, and contacts an inner surface of the fusing belt 120. The elastic layer 151 has heat resistance and low thermal conductivity so that heat loss from the fusing belt 120 is prevented, and has elasticity in order to allow the fusing belt 120 to be curved and maintain the nip width. The elastic layer 151 may be formed of a rubber material or a resin-based silicon sponge, and may have a thickness of about 2 to 6 mm.

The supporting layer 155 is attached to the elastic layer 151 to support the elastic layer 151. The supporting layer 155 is extended in the length direction of the first and second fusing rollers 130 and 140, and may have a square cross-section. The supporting layer 155 may be formed of iron, SUS, or aluminium in such a way as to be able to support a load from the compressing roller 160.

The nip guide 150 forms an additional nip N3 by being engaged with the compressing roller 160. The additional nip N3 may increase the nip amount greatly with nips N1 and N2 between the compressing roller 160 and the first and second fusing rollers 130 and 140. When the nip amount is increased, a dwell time of the printing medium P is increased so that the fusing quality is improved and fusing may be performed at high speeds. In addition, even when the compressing roller 160 is smaller than a general compressing roller, sufficient nip amount may be ensured by the nip guide 150, and thus, the fusing device 100 may have a compact size and fabrication costs may be reduced. Moreover, since the sufficient nip amount is ensured by the nip guide 150, pressure between the compressing roller 160 and the first and second fusing rollers 130 and 140 is not needed to be high, and thus, durability of the fusing device 100 may be improved.

The compressing roller 160 is disposed on an outer portion of the fusing belt 120. The compressing roller 160 is elastically biased by an elastic member such as a spring (not shown) to elastically compress the first and second fusing rollers 130 and 140 and the nip guide 150 with a load about 30N to about 300N. The compressing roller 160 may include a release layer 161, an elastic layer 163, and a supporting layer 165. The release layer 161 may be an outer layer, and the elastic layer 163 and the supporting layer 165 may be sequentially disposed beneath the release layer 161.

The release layer 161 is a layer for improving a releasing property of a surface of the compressing roller 160, and may be formed of a silicon rubber, a fluoroelastomer, or a fluoropolymer such as PFA, PTFE, tetrafluoroethylene hexafluoropropylene copolymer (FEP), or perfluoro ethylene hexafluoropropylene copolymer (PFEP) having an anti-abrasion property and for improving the releasing property of the surface of the compressing roller 160. A thickness of the release layer 161 may be about 10 μm to about 100 for example, 20 μm to 50 μm.

The elastic layer 163 may be formed of a rubber material such as a silicon rubber, a solid rubber, or a fluoroelastomer in order to increase the adhesion between the printing medium P and the first and second fusing rollers 130 and 140 and to ensure formation of the nips N1, N2, and N3. When the elastic layer 163 is formed as a single layer formed of a rubber material, a thickness of the elastic layer 163 may be designed to be in a range of about 3 mm to about 10 mm in consideration of usage conditions of the fusing device. The elastic layer 163 may be formed as a double-layered structure including a rubber layer and a sponge layer to improve the durability of the fusing device 100. Here, the sponge layer may be formed of a silicon sponge rubber. When the elastic layer 163 is formed as a double-layered structure including a rubber layer and a sponge layer, the rubber layer is formed to a thickness of 1 mm or less and the sponge layer is formed to a thickness within a range of about 3 mm to about 10 mm in consideration of the usage conditions of the fusing device 100 so that the entire thickness of the elastic layer 163 is within a range of about 3 mm to about 11 mm.

The supporting layer 165 supports the entire compressing roller 160, and has thermal resistance and a predetermined degree of intensity. For example, the supporting layer 165 may be formed of a non-magnetic metal such as aluminium or a magnetic metal such as SUS, and may be formed as a steel hollow shaft or as a rod. When the supporting layer 165 is formed of a non-magnetic metal, the supporting layer 165 is not affected by electromagnetic induction of the magnetic flux generator 110. The supporting layer 165 may be a steel hollow shaft having a thickness of about 1.5 mm and an outer diameter of about 20 mm to about 30 mm.

The compressing roller 160 is elastically pressed against the first and second fusing rollers 130 and 140 and the nip guide 150 while the fusing belt 120 is disposed between the compressing roller 160 and the first and second fusing rollers 130 and 140 and the nip guide 150 so as to form the nips N1, N2, and N3 on portions of the fusing belt 120. The nip N1 as an upper nip is formed by the first fusing roller 130 and the compressing roller 160, the nip N2 as a lower nip is formed by the second fusing roller 140 and the compressing roller 160, and the nip N3 as an intermediate nip is formed by the nip guide 150 and the compressing roller 160. Widths of the nips N1, N2, and N3 may be adjusted by changing areas compressed by the compressing roller 160. The printing medium P passes through the nips N1, N2, and N3 between the fusing belt 120 and the compressing roller 160. In the fusing device 100 according to the current embodiment, the plurality of nips N1, N2, and N3 are formed, and thus, the sufficient width of the nips N1, N2, and N3, which is the width necessary to fuse the toner on the printing medium P, may be ensured while reducing the entire size of the fusing device 100. Accordingly, the dwell time of the printing medium P on the nips N1, N2, and N3 is increased, and thus, the fusing quality may be stably ensured when a high speed printing operation is performed.

Since the nips N1, N2, and N3 are formed along with an outer circumference of the compressing roller 160, the printing medium P passing through the nips N1, N2, and N3 is curved at a predetermined angle. The curvature angle of the printing medium P may vary depending on the size of the first and second fusing rollers 130 and 140, the size of the compressing roller 160, or the forming locations of the nips N1, N2, and N3. In an image forming apparatus (refer to FIG. 8) adopting the fusing device 100, flow of the printing media P may vary according to disposing locations of components forming the image forming apparatus. Thus, according to the fusing device 100 of the current embodiment, the curvature angle of the printing medium P may be adjusted easily in correspondence with an arrangement of the components forming the image forming apparatus by controlling the size of the first and second fusing rollers 130 and 140, the size of the compressing roller 160, and the forming locations of the nips N1, N2, and N3.

A temperature sensor (not shown) may be disposed on an outer portion of the fusing belt 120 in order to prevent the fusing temperature generated by the heating layer 125 of the fusing belt 120 from being greater than a set temperature. For example, the temperature sensor may be located adjacent to the upper nip N1, and may be installed to contact the fusing belt 120 or not in contact with the fusing belt 120. The non-contact thermistor prevents scratches from being formed on the fusing belt 120, so that defects do not occur due to the thermistor. The temperature sensor detects the surface temperature of the fusing belt 120 and adjusts the amount of electric current flowing in the coil 111 so as to maintain an appropriate fusing temperature. The temperature sensor may be a thermistor or a thermopile.

Next, operations of the fusing device 100 will be described with reference to FIGS. 1 through 3.

When an RF current is applied to the coil 111 of the magnetic flux generator 110, a magnetic field is generated around the coil 111 by electromagnetic induction. The flow of the magnetic field generated from the coil 111, that is, the magnetic flux, forms a closed loop magnetic circuit. The magnetic flux generated by the RF current generates an eddy current in the heating layer 125 while passing through the heating layer 125, and the heating layer 125 generates heat due to resistive heating by the eddy current.

On the other hand, one of the first and second fusing rollers 130 and 140, and the compressing roller 160 is driven to rotate by a motor (not shown). When one of the first and second fusing rollers 130 and 140 is rotated, the compressing roller 160 and the other of the first and second fusing roller 130 and 140 become driven rollers. When the compressing roller 160 is rotated, the first and second fusing rollers 130 and 140 become the driven rollers. The driven rollers are driven by frictional force between the fusing belt 120 and the first and second fusing rollers 130 and 140 and frictional force between the compressing roller 160 and the fusing belt 120.

As one of the first and second fusing rollers 130 and 140 or the compressing roller 160 is driven, the fusing belt 120 is rotated by the frictional force, and the printing medium P is conveyed to the nips N1, N2, and N3 between the fusing belt 120 and the compressing roller 160. The fusing belt 120, which is induction heated by the magnetic flux generator 110, transfers heat to the printing medium P. In addition, a predetermined pressure generated due to the elastic adhesion between the first and second fusing rollers 130 and 140, the nip guide 150, and the compressing roller 160 is transferred to the printing medium P. The heat and pressure transferred to the printing medium P from the nips N1, N2, and N3 fuse the transferred toner onto the printing medium P.

FIG. 4 shows a modified example of the core pieces 113-2 located on ends of the main core 113 in the fusing device 100. As described above, the coil 111 is wound along the length direction of the first and second fusing rollers 130 and 140, and opposite ends of the coil 111 in the length direction of the first and second fusing rollers 130 and 140 are curved. Therefore, magnetic flux density is lowered at both ends of the coil 111 in the length direction, and thus the induction heating property thereat may be degraded. Therefore, core pieces 113-2' at both ends of the main core 113 may be formed to have E-shaped cross-sections. Here, a center protrusion **113-2*b*' in each of the core pieces 113-2' is located inside the wound coil 111. The center protrusion 113-2*b*' increases the magnetic flux density at both ends of the coil 111 in order to improve the induction heating efficiency. Other parts 113-2*a*' other than the protrusion 113-2*b*' in each of the core pieces 113-2' are substantially the same as the core pieces 113-2 in the previous embodiment. In the present modified example, the core pieces 113-2' located at end portions of the main core 113 have the E-shaped cross-sections. However, if necessary, the core pieces (113-1 of FIG. 1) located at a center portion of the main core 113** may also have E-shaped cross-sections.

FIG. 5 shows another modified example of the core pieces 113-2 in the fusing device 100.

Each of the core pieces 113-2" at both ends of the main core 113 may include a body core **113-2*a*" and a center core 113-2*b*". The body core 113-2*a*" is substantially the same as the core piece 113-2 at both ends of the main core 113 in the previous embodiment. A side of the center core 113-2*b*" contacts a center portion of the body core 113-2*a*" and the other side of the center core 113-2*b*" is bent inward to be located inside of the coil 111. The center core 113-2*b*" increases the magnetic flux density at both ends of the coil 111 like the protrusion 113-2*b*' in the previous modified example, so as to improve the induction heating efficiency. Moreover, the bent structure of the center core 113-2*b*" may prevent both ends of the coil 111 from protruding out of the core pieces 113-2"**.

Figure 6:
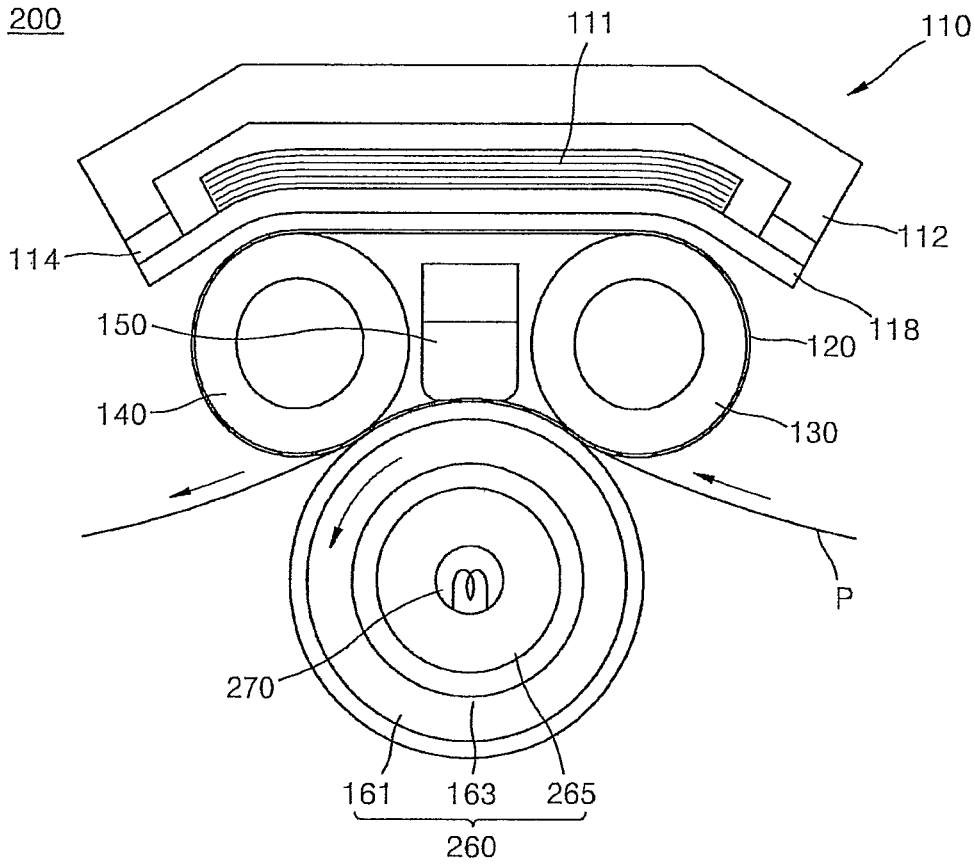
FIG. 6 is a schematic cross-sectional view of a fusing device according to another embodiment of the present general inventive concept.

FIG. 6 is a cross-sectional view of a fusing device 200 according to another embodiment of the present general inventive concept. The fusing device 200 of the current embodiment further includes a second heat source 270 that heats a compressing roller 260, in addition to the fusing device 100 of the previous embodiment. Although the supporting layer 165 of the compressing roller 160 in the previous embodiment may be a steel hollow shaft or a rod, a supporting layer 265 of the compressing roller 260 in the current embodiment may be a hollow shaft for receiving the second heat source 270. The second heat source 270 is disposed in the compressing roller 260, and may be a halogen lamp. Since the fusing belt 120 has relatively low heat capacity, temperatures at the nips N1, N2, and N3 may be lowered during continuous high speed printing operations. Thus, in the fusing device 200 according to the current embodiment, the second heat source 270 additionally heats the compressing roller 260 in order to prevent the temperature at the nips N1, N2, and N3 from decreasing, and thus, the fusing quality of a high speed printing operation may be improved.

Figure 7:
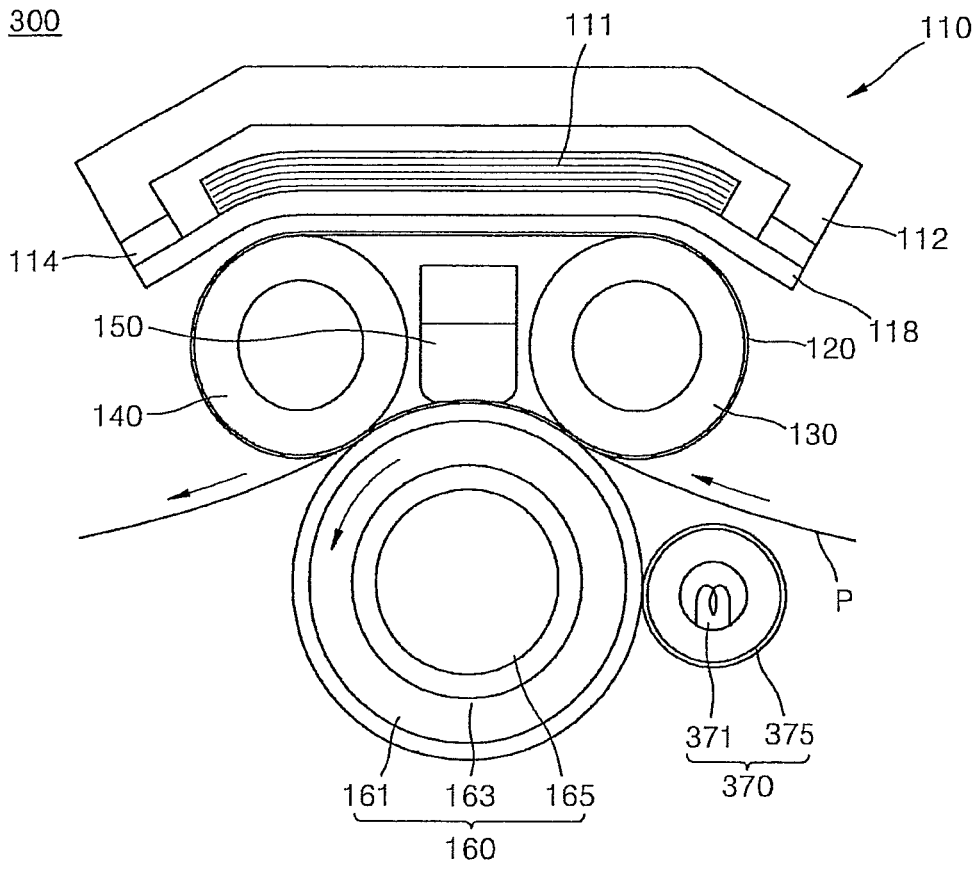
FIG. 7 is a schematic cross-sectional view of a fusing device according to another embodiment of the present general inventive concept.

FIG. 7 is a schematic cross-sectional view of a fusing device 300 according to another embodiment of the present general inventive concept.

The fusing device 300 of the current embodiment further includes a second heat source 370 that heats the compressing roller 160 from outside the compressing roller 160, in addition to the fusing device 100 described with reference to FIGS. 1 through 3. The second heat source 370 may include, for example, a halogen lamp 371, and a thin pipe 375 surrounding the halogen lamp 371. The thin pipe 375 is formed of a metal having high thermal conductivity. The second heat source 370 may be disposed on the outer circumference of the compressing roller 160 to be adjacent to the upper nip N1. In the fusing device 300 of the current embodiment, the second heat source 370 additionally heats the compressing roller 160 in order to prevent temperatures at the nips N1, N2, and N3 from decreasing, and thereby improving the fusing quality of a high speed printing operation.

Figure 8:
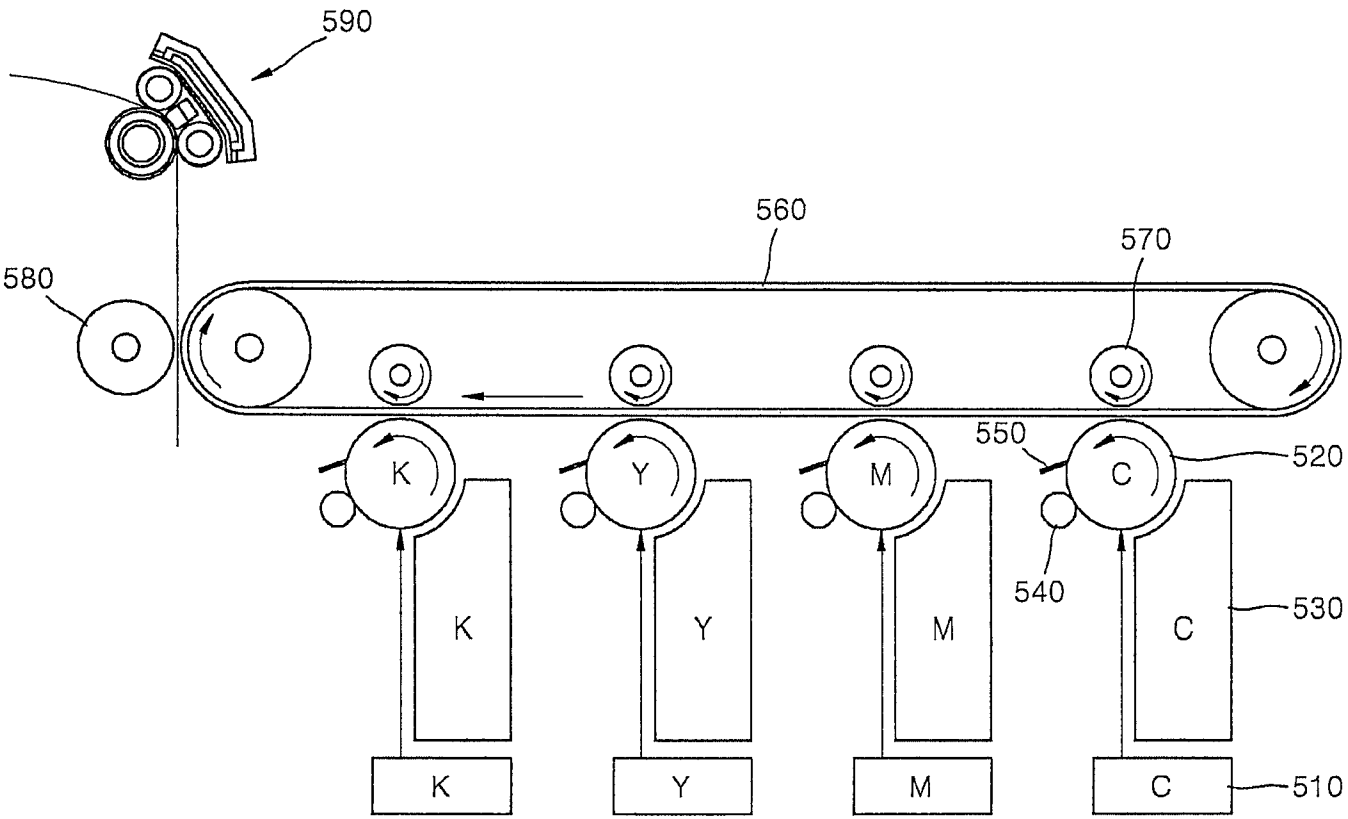
FIG. 8 is a schematic block diagram of an image forming apparatus according to an embodiment of the present general inventive concept.

FIG. 8 is a schematic block diagram of an electrophotographic image forming apparatus according to an embodiment of the present general inventive concept.

Referring to FIG. 8, the image forming apparatus includes an exposure device 510, a photosensitive drum 520, a developing device 530, an intermediate transfer belt 560, first and second transferring rollers 570 and 580, and a fusing device 590. The fusing device 590 may be one of the fusing devices described in the previous embodiments.

In order to print color images, the exposure device 510, the photosensitive drum 520, and the developing device 530 may be formed for each of colors. For example, the exposure device 510, the photosensitive drum 520, and the developing device 530 may be disposed for each of black (K), magenta (M), yellow (Y), and cyan (C) colors.

The exposure unit 510 may be a light scanning unit that irradiates light in a length direction of the photosensitive drum 520 (that is, main scanning direction), or a linear array light source for irradiating a light beam corresponding to the length direction of the photosensitive drum 520. The exposure device 510 emits light that is modulated in correspondence with image information of K, M, Y, and C colors.

The photosensitive drum 520 is an example of a photosensitive object, and includes a photosensitive layer to a predetermined thickness on an outer circumferential surface of a metal cylindrical pipe. Although it is not shown in the drawings, a photosensitive belt may be used as the photosensitive object. The outer circumferential surface of the photosensitive drum 520 is an exposure target surface. The exposure device 510 exposes the exposure target surface of the photosensitive drum 520 in the length direction thereof, and the exposure target surface is moved in a sub-scanning direction as the photosensitive drum 520 rotates, and accordingly, a two-dimensional electrostatic latent image is formed on the exposure target surface of the photosensitive drum 520.

The electrostatic latent images corresponding to K, M, Y, and C image information are formed on four photosensitive drums 520. The four developing devices 530 supply K, M, Y, and C toners respectively to the photosensitive drums 520 in order to form K, M, Y, and C toner images.

A charging roller 540 is disposed on an upper stream side of the exposed portion on the outer circumferential surface of the photosensitive drum 520. The charging roller 540 is rotated while contacting the photosensitive drum 520 to charge the surface of the photosensitive drum 520 to an even potential. A charging bias is applied to the charging roller 540. Instead of using the charging roller 540, a corona charger (not shown) may be used.

The intermediate transfer belt 560 is an example of an intermediate transferer that transfers the toner image formed on the photosensitive drum 520 to the printing medium P. An intermediate transfer drum may be used as the intermediate transferer instead of the intermediate transfer belt 560. The intermediate transfer belt 560 circulates while contacting the photosensitive drums 520. The K, M, Y, and C toner images formed on the photosensitive drums 520 are transferred onto the intermediate transfer belt 560 while overlapping each other by the first transfer bias applied to the first transfer roller 570. A cleaning device 550 may be formed on a lower stream of the transfer portion on the outer circumferential surface of the photosensitive drum 520. Remaining toner images after the transferring operation are removed by the cleaning devices 550. The toner images transferred on the intermediate transfer belt 560 are transferred onto the printing medium P by a second transfer bias applied to the second transfer roller 580.

The printing medium P on which the toner images are transferred is conveyed to the fusing device 590. The toner images transferred on the printing medium P are fused on the printing medium P due to the heat and pressure at the nips (N1, N2, and N3 of FIG. 2) of the fusing device 590, and then, the printing operation is completed.

As described above, as shown in FIG. 2, the nips N1, N2, and N3 are formed along with the outer circumference of the compressing roller 160 in the fusing device 590, and accordingly, the printing medium P is curved at a predetermined angle while passing through the nips N1, N2, and N3. Therefore, design of arranging the components forming the image forming apparatus may be dealt with by adjusting the size of the first and second fusing rollers 130 and 140, the size of the compressing roller 160, or the forming locations of the nips N1, N2, and N3.

The image forming apparatus of the current embodiment forms color images; however, the present general inventive concept is not limited thereto. For example, in order to form mono-color images, the image forming apparatus may include one exposure device 510, one photosensitive drum 520, and one developing device 530. Moreover, other components except for the fusing device 590 in the image forming apparatus, that is, the exposure device 510, the photosensitive drum 520, the developing device 530, the intermediate transfer belt 560, and the first and second transfer rollers 570 and 580, are examples of electrophotographic type printing units for transferring toner images onto a printing medium, and other well known printing units may be used in the image forming apparatus of the present general inventive concept.

The induction heating type fusing device and the image forming apparatus including the fusing device according to the previous embodiments have the following effects.

A large amount of nip may be ensured by the three rollers and the nip guide, and thus, the size of the fusing device may be compact owing to the ensured nip amount.

The dwell time of the printing medium is increased due to the large amount of nip, and thus, the fusing quality of the fusing device may be improved and a high speed fusing operation may be performed.

In addition, since the large amount of nip is ensured, there is no need to apply high pressure between the fusing roller and the compressing roller, and the durability of the fusing device is improved.

Also, since the temperature rises fast due to the induction heating on the surface of the heating belt, the FPOT may be reduced, and the fusing device shows low power consumption during standby.

In addition, since the size of the fusing device is compact, the temperature rising time may be reduced.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A fusing device comprising:

a fusing belt formed as a closed loop;

a magnetic flux generator disposed outside the fusing belt to emit magnetic flux for induction heating of the fusing belt;

a first fusing roller and a second fusing roller that are disposed in parallel with each other inside the fusing belt and support the fusing belt;

a nip guide located between the first fusing roller and the second fusing roller; and a compressing roller disposed on an outer portion of the fusing belt for compressing against the first and second fusing rollers and the nip guide to form nips on portions of the fusing belt, wherein the magnetic flux generator includes a coil wound along a length direction of the first and second fusing rollers, and a cross-section of the coil is curved along an outer circumference of the fusing belt with respect to the first fusing roller and with respect to the second fusing roller.

2. The fusing device of claim 1, wherein the magnetic flux generator further comprises:

a magnetic core disposed to face the fusing belt while the coil is disposed between the magnetic core and the fusing belt to guide magnetic flux generated by the coil; and a bobbin supporting the coil and the magnetic core.

3. The fusing device of claim 2, wherein a distance between the coil and the fusing belt is maintained constant.

4. The fusing device of claim 2, wherein the magnetic core comprises:

a main core including a plurality of core pieces that are arranged in the length direction of the first and second fusing rollers; and two end cores extending in the length direction of the first and second fusing rollers and contacting ends of the plurality of core pieces.

5. The fusing device of claim 4, wherein each of the plurality of core pieces has an arch-shaped cross-section.

6. The fusing device of claim 4, wherein core pieces located at ends among the plurality of core pieces have an E-shaped cross-section having a protruding center portion.

7. The fusing device of claim 4, wherein core pieces located at ends among the plurality of core pieces have a core body having an arch-shaped cross-section and a center core having a first side contacting a center portion of the core body and a second side located inside the coil.

8. The fusing device of claim 1, wherein the fusing belt comprises a release layer and a heating layer.

9. The fusing device of claim 8, wherein the fusing belt further comprises an elastic layer.

10. The fusing device of claim 9, wherein the release layer is an outer layer of the fusing belt, the heating layer is an inner layer of the fusing belt, and the elastic layer is disposed therebetween.

11. The fusing device of claim 8, wherein the heating layer is formed of a conductive magnetic material.

12. The fusing device of claim 1, wherein each of the first and second fusing rollers comprises a supporting layer and a heat insulating layer surrounding the supporting layer.

13. The fusing device of claim 1, wherein the nip guide comprises an elastic layer and a supporting layer supporting the elastic layer.

14. The fusing device of claim 1, wherein the compressing roller comprises a release layer, an elastic layer, and a supporting layer.

15. The fusing device of claim 14, wherein the supporting layer of the compressing roller is a hollow shaft or a rod.

16. The fusing device of claim 1, further comprising a second heat source disposed inside the compressing roller.

17. The fusing device of claim 16, wherein the second heat source is a halogen lamp.

18. The fusing device of claim 1, further comprising a second heat source disposed outside of the compressing roller.

19. The fusing device of claim 18, wherein the second heat source is a halogen lamp and a thin pipe surrounding the halogen lamp.

20. An image forming apparatus comprising:

electrophotographic type printing units for transferring toner images onto a printing medium; and a fusing device for fusing the transferred toner images on the printing medium, wherein the fusing device includes:

a fusing belt formed as a closed loop;

a magnetic flux generator disposed outside the fusing belt to emit magnetic flux for induction heating of the fusing belt;

a first fusing roller and a second fusing roller that are disposed in parallel with each other inside the fusing belt and support the fusing belt;

a nip guide located between the first fusing roller and the second fusing roller; and a compressing roller disposed on an outer portion of the fusing belt for compressing against the first and second fusing rollers and the nip guide to form nips on portions of the fusing belt, wherein the magnetic flux generator includes a coil wound along a length direction of the first and second fusing rollers, and a cross-section of the coil is curved along an outer circumference of the fusing belt with respect to the first fusing roller and with respect to the second fusing roller.

21. The image forming apparatus of claim 20, wherein the magnetic flux generator further comprises:

a magnetic core disposed to face the fusing belt while the coil is disposed between the magnetic core and the fusing belt to guide magnetic flux generated by the coil; and a bobbin supporting the coil and the magnetic core.

22. The image forming apparatus of claim 21, wherein a distance between the coil and the fusing belt is maintained constant.

23. The image forming apparatus of claim 21, wherein the magnetic core comprises:

a main core including a plurality of core pieces that are arranged in the length direction of the first and second fusing rollers; and two end cores extending in the length direction of the first and second fusing rollers and contacting ends of the plurality of core pieces.

24. The image forming apparatus of claim 20, wherein the fusing belt comprises a release layer and a heating layer.

25. The image forming apparatus of claim 24, wherein the fusing belt further comprises an elastic layer.

26. The image forming apparatus of claim 20, wherein each of the first and second fusing rollers comprises a supporting layer and a heat insulating layer surrounding the supporting layer.

27. The image forming apparatus of claim 20, wherein the nip guide comprises an elastic layer and a supporting layer supporting the elastic layer.

28. The image forming apparatus of claim 20, wherein the compressing roller comprises a release layer, an elastic layer, and a supporting layer.

29. The image forming apparatus of claim 20, further comprising a second heat source disposed inside the compressing roller.

30. The image forming apparatus of claim 20, further comprising a second heat source disposed outside of the compressing roller.

* * * * *